US011413482B1

(12) United States Patent
Beard

(10) Patent No.: US 11,413,482 B1
(45) Date of Patent: Aug. 16, 2022

(54) FIREFIGHTING GAS RELEASING APPARATUSES AND METHODS

(71) Applicant: Philip Beard, Alexandria, LA (US)

(72) Inventor: Philip Beard, Alexandria, LA (US)

( * ) Notice: Subject to any disclaimer, the term of this patent is extended or adjusted under 35 U.S.C. 154(b) by 0 days.

(21) Appl. No.: 17/536,678

(22) Filed: Nov. 29, 2021

(51) Int. Cl.
*A62C 3/02* (2006.01)

(52) U.S. Cl.
CPC ..... *A62C 3/025* (2013.01); *A62C 3/02* (2013.01); *A62C 3/0207* (2013.01)

(58) Field of Classification Search
CPC ..... A62C 3/025; A62C 3/0207; A62C 35/10; A62C 99/0027; A62C 3/0228; A62C 3/02; A62C 8/005; A62C 19/00; B64D 1/16; B64D 25/12; F42B 12/46; F42B 12/50; F42B 8/22; F14B 9/0087; F17C 2201/0128
USPC ..... 169/30, 36, 46; 102/367, 368, 369, 370; 473/577
See application file for complete search history.

(56) References Cited

U.S. PATENT DOCUMENTS 2,174,606 A 10/1939 Tansill
2,450,537 A 10/1948 Williamson
2,515,832 A * 7/1950 Mournaud ..... F42B 12/50 169/36
2,665,768 A 1/1954 Talbot
3,011,674 A * 12/1961 Jackson ..... F17C 1/12 220/567
3,070,172 A 12/1962 Carter, Jr.
3,132,695 A * 5/1964 Peltier ..... A62C 35/645 D29/128

(Continued)

FOREIGN PATENT DOCUMENTS

WO WO-9212763 A1 * 8/1992 ..... A62C 3/02

*Primary Examiner* — Cody J Lieuwen
*Assistant Examiner* — Kevin Edward Schwartz
(74) *Attorney, Agent, or Firm* — R. Keith Harrison

(57) ABSTRACT

Firefighting gas releasing apparatuses may include a trigger housing. A containment shell having a plurality of interfaceable shell sections may be carried by the trigger housing. The shell sections may be positional in a closed shell configuration and an open shell configuration. A shell interior may be formed by the shell sections in the closed shell configuration of the containment shell. The shell interior may be configured to contain a supply of at least one fire-suppressing gas. A plurality of shell retention members may removably engage the shell sections. A shell retention strap may releasably engage the shell retention members. The shell retention strap and the shell retention members may retain the shell sections in the closed shell configuration of the containment shell. A retainer piston may be disposed in the trigger housing. The retainer piston may be selectively positional in a strap-retaining configuration engaging the shell retention strap and a strap-releasing configuration disengaging the shell retention strap. The retainer piston may be configured to engage the shell retention strap and maintain the shell sections of the containment shell in the closed shell configuration and disengage the shell retention strap for release of the shell retention strap from the shell retention members, disengagement of the shell retention members from the shell sections and disengagement of the shell sections from each other in deployment of the containment shell to the open shell configuration.

16 Claims, 11 Drawing Sheets

(56) References Cited

U.S. PATENT DOCUMENTS

| | | | | |
|---|---|---|---|---|
| 4,113,020 | A * | 9/1978 | Panetta | A47G 33/0872 428/11 |
| 4,230,255 | A * | 10/1980 | Coulter | E04B 1/3211 228/184 |
| 4,344,489 | A | 8/1982 | Bonaparte | |
| 4,964,469 | A * | 10/1990 | Smith | A62C 19/00 169/53 |
| 5,590,717 | A * | 1/1997 | McBay | A62C 35/10 169/69 |
| 6,513,602 | B1 | 2/2003 | Lewis et al. | |
| 6,543,365 | B1 * | 4/2003 | Vasel | H02M 7/48 102/370 |
| 7,121,353 | B2 | 10/2006 | Setzer | |
| 7,261,165 | B1 * | 8/2007 | Black | F42B 12/50 169/29 |
| 7,478,680 | B2 | 1/2009 | Sridharan et al. | |
| 7,484,567 | B2 | 2/2009 | Demange et al. | |
| 9,149,672 | B2 | 10/2015 | Al-Anzi | |
| 9,587,750 | B2 * | 3/2017 | Ringer | F16K 31/1266 |
| 2003/0006047 | A1 | 1/2003 | Silverstein et al. | |
| 2016/0216091 | A1 | 7/2016 | Erickson et al. | |
| 2016/0367846 | A1 * | 12/2016 | Haines | A62C 31/05 |
| 2019/0086008 | A1 * | 3/2019 | Graf | F16L 37/1225 |
| 2021/0038935 | A1 * | 2/2021 | Lakshmi | F16B 5/0266 |

* cited by examiner

FIREFIGHTING GAS RELEASING APPARATUSES AND METHODS

FIELD

Illustrative embodiments of the disclosure are generally directed to apparatuses and methods for fighting fires. More particularly, illustrative embodiments of the disclosure arc directed to firefighting gas releasing apparatuses and methods in which a fire-suppressing gas such as carbon dioxide is released above at least a portion of at least one fire to form a dome-shaped gaseous fog or cloud enclosure which encloses, suppresses and extinguishes the fire.

BACKGROUND

The background description provided herein is solely for the purpose of generally presenting the context of the illustrative embodiments of the disclosure. Aspects of the background description are neither expressly nor impliedly admitted as prior art against the claimed subject matter.

Every year, incalculable billions of dollars in property damage and thousands of lives lost are attributable to the ravages of forest tires and similar fire tragedies. Homes, businesses and families are destroyed by the widespread destruction created by massive wildfires. While it is a useful protection tool, insurance cannot adequately replace the losses of property, possessions, life and health. The loss of forest vegetation, such as that caused by wildfires in the rainforests, does irreparable damage to the world environmental system. Rampant erosion resulting from loss of surface vegetation creates mudslides in hilly and mountainous terrain, causing severe damage to roads, residences and undamaged timber. Mudslides can also block rivers and streams with disastrous flood damage.

Wildlife may be the biggest loser of all in massive forest fires. Aside from the obvious loss of habitat, wildlife survivors may be forced into heavily populated areas to compete for space and food. Oftentimes, wildlife is simply eliminated or trapped and moves to less-adaptable regions.

As of Jan. 10, 2020, massive wildfires which began in Australia in October 2019 have resulted in over 30 fatalities and the loss of over 2,200 homes. News reports estimate that a half-billion animals have been killed by the wildfires. An area roughly the size of Massachusetts has been reduced to scorched earth and ash. Initial efforts to curtail the spread of wildfire have proven to be ineffective with respect to timely and specific efforts, thus resulting in the current devastating destruction.

A condition which is created by some wildfires is gaining notoriety and was first verified in the Canberra bush fires of 2003. The phenomenon is known as "fire whirl" or "fire devil" and develops from rising heat and turbulent winds in a wildfire. Variously referred to as a "fire tornado" or "firenado", these phenomena only resemble tornadoes and are not classified as such. Fire whirls are very dangerous because they can appear suddenly and reach a height of 160 feet to ½ mile for very large fire whirls. Destruction caused by fire whirls can be similar to that caused by tornadoes and may include uprooted trees and scattered, burning debris. The occurrence of fire whirls presents a very hazardous condition to firefighters, aircraft and other ground personnel.

Firefighting gas releasing apparatuses and methods in which a fire-suppressing gas such as carbon dioxide is released above at least a portion of at least one fire to form a dome-shaped gaseous fog or cloud enclosure which encloses, suppresses and extinguishes the fire may be desirable for some applications.

SUMMARY

Illustrative embodiments of the disclosure are generally directed to firefighting gas releasing apparatuses in which a fire-suppressing gas such as carbon dioxide is released above at least a portion of at least one fire to form a dome-shaped gaseous fog or cloud enclosure which encloses, suppresses and extinguishes the fire. An illustrative embodiment of the firefighting gas releasing apparatuses may include a trigger housing. A containment shell having a plurality of interfaceable shell sections may be carried by the trigger housing. The plurality of interfaceable shell sections may be positional in a closed shell configuration and an open shell configuration. A shell interior may be formed by the plurality of interfaceable shell sections in the closed shell configuration of the containment shell. The shell interior may be configured to contain a supply of at least one fire-suppressing gas. A plurality of shell retention members may removably engage the interfaceable shell sections. A shell retention strap may releasably engage the shell retention members. The shell retention strap and the shell retention members may retain the interfaceable shell sections in the closed shell configuration of the containment shell. A retainer piston may be disposed in the trigger housing. The retainer piston may be selectively positional in a strap-retaining configuration engaging the shell retention strap and a strap-releasing configuration disengaging the shell retention strap. The retainer piston may be configured to engage the shell retention strap and maintain the interfaceable shell sections of the containment shell in the closed shell configuration and disengage the shell retention strap for release of the shell retention strap from the shell retention members, disengagement of the shell retention members from the interfaceable shell sections and disengagement of the interfaceable shell sections from each other in deployment of the containment shell to the open shell configuration. Firefighting gas releasing methods are also disclosed.

Illustrative embodiments of the disclosure are further generally directed to firefighting gas releasing methods. An illustrative embodiment of the firefighting gas releasing methods may include obtaining at least one firefighting gas releasing apparatus having a trigger housing, a retainer piston positional in a strap-retaining configuration and a strap-releasing configuration in the trigger housing and an openable containment shell with a plurality of shell sections releasably carried by the trigger housing; deploying the containment shell in a closed shell configuration by placing the plurality of shell sections into interfacing engagement with each other; placing a plurality of shell retention members into engagement with the plurality of shell sections, respectively, of the containment shell; placing a shell retention strap into engagement with the plurality of shell retention members; deploying the retainer piston in the strap-retaining configuration to engage the shell retention strap and retain the containment shell in the closed shell configuration; placing at least one fire-suppressing gas in the containment shell; deploying the firefighting gas releasing apparatus over at least a portion of at least one fire; and forming at least one gaseous fog enclosure over the at least a portion of the at least one fire by opening the containment shell and releasing the at least one fire-suppressing gas from the containment shell over the at least a portion of the at least one fire by deploying the retainer piston from the strap-retaining configuration to the strap-releasing configuration.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right". "front" "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5:
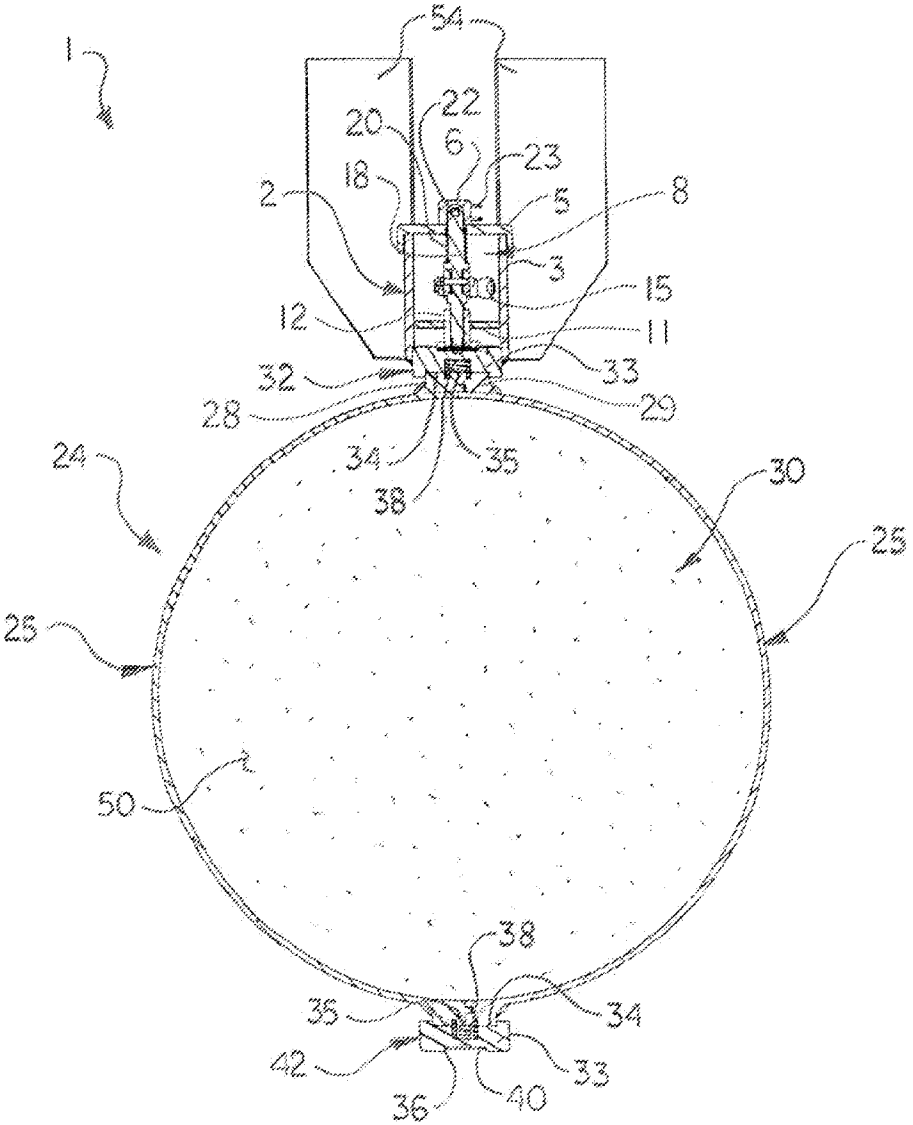
FIG. 5 is a sectional view, taken along section lines 5-5 in FIG. 4, of the trigger housing and containment shell of the illustrative firefighting gas releasing apparatus.

Referring to FIGS. 1-14 of the drawings, an illustrative embodiment of the firefighting gas releasing apparatus, hereinafter apparatus, of the disclosure is generally indicated by reference numeral 1. The apparatus 1 may include a trigger housing 2. A containment shell 24 may extend from the trigger housing 2. The containment shell 24 may include multiple interfaceable shell sections 25. The interfaceable shell sections 25 may be positional in an assembled, closed shell configuration (FIGS. 1, 2 and 4-6) and a disassembled, open shell configuration (FIG. 14). As illustrated in FIG. 5, in the closed shell configuration of the containment shell 24, a shell interior 30 may be formed by the interfaceable shell sections 25. The shell interior 30 may be configured to contain a supply of at least one fire-suppressing gas 50.

Multiple shell retention members 32, 42 may removably engage the interfaceable shell sections 25. A shell retention strap 40 may releasably engage the shell retention members 32, 42. The shell retention strap 40 and the shell retention members 32, 42 may retain the interfaceable shell sections 25 in the closed shell configuration of the containment shell 24. As illustrated in FIGS. 9-12, the shell retention strap 40 may have opposite strap ends 41. Piston openings 44 may extend through the shell retention strap 40 at or adjacent to the respective strap ends 41 for purposes which will be hereinafter described.

Figure 10:
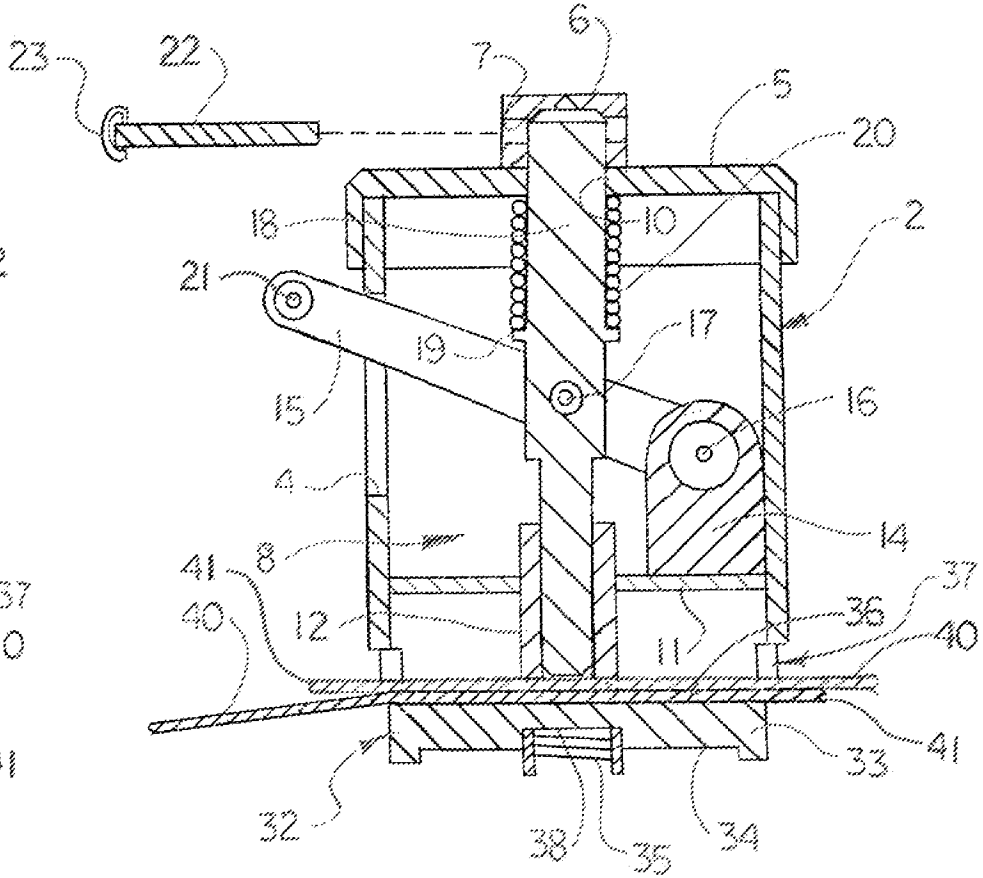
FIG. 10 is an enlarged sectional view of the trigger housing with the retainer piston shown in the strap-releasing configuration and disengaging the shell retention strap to release the containment shell to the released, open shell configuration.
Figure 9:
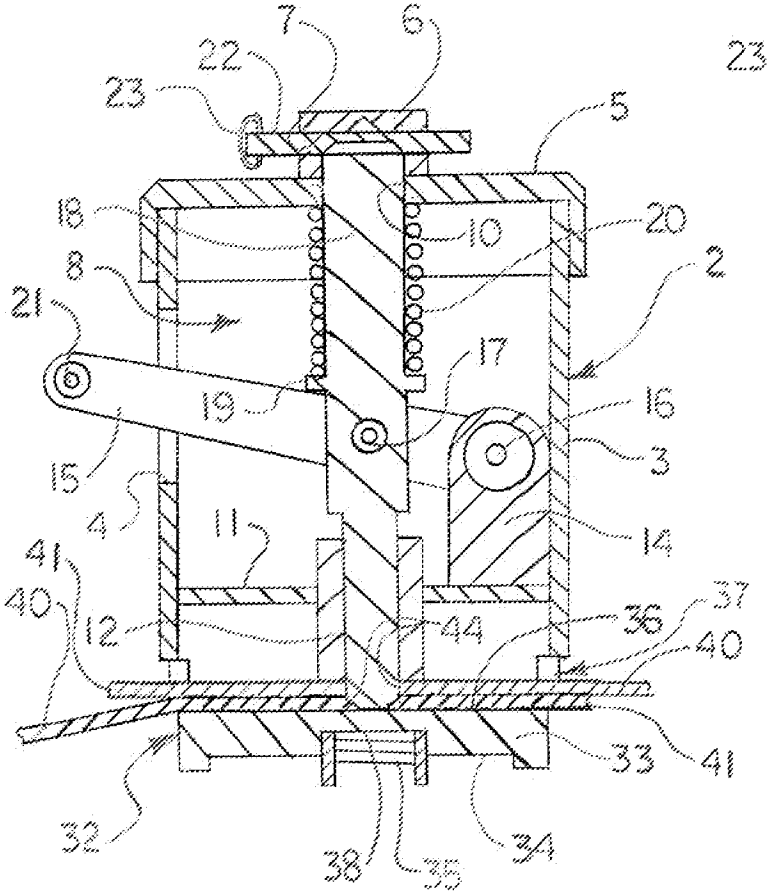
FIG. 9 is an enlarged sectional view of the trigger housing with the retainer piston shown in the strap-retaining configuration and engaging the shell retention strap to retain the shell retention strap and the containment shell in the pre-released, closed shell configuration via the shell retention members (one of which is illustrated)
Figure 11:
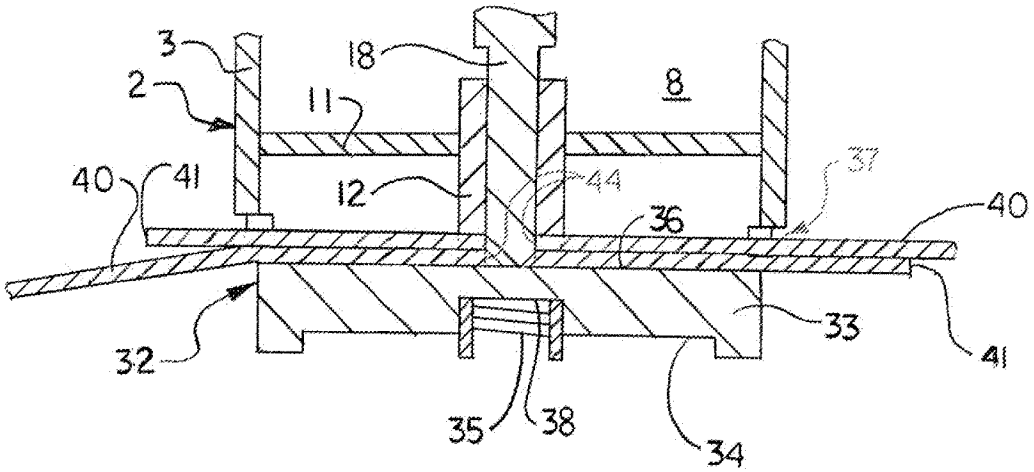
FIG. 11 is an enlarged sectional view of the retainer piston engaging the shell retention strap in the strap-retaining configuration of the retainer piston.
Figure 12:
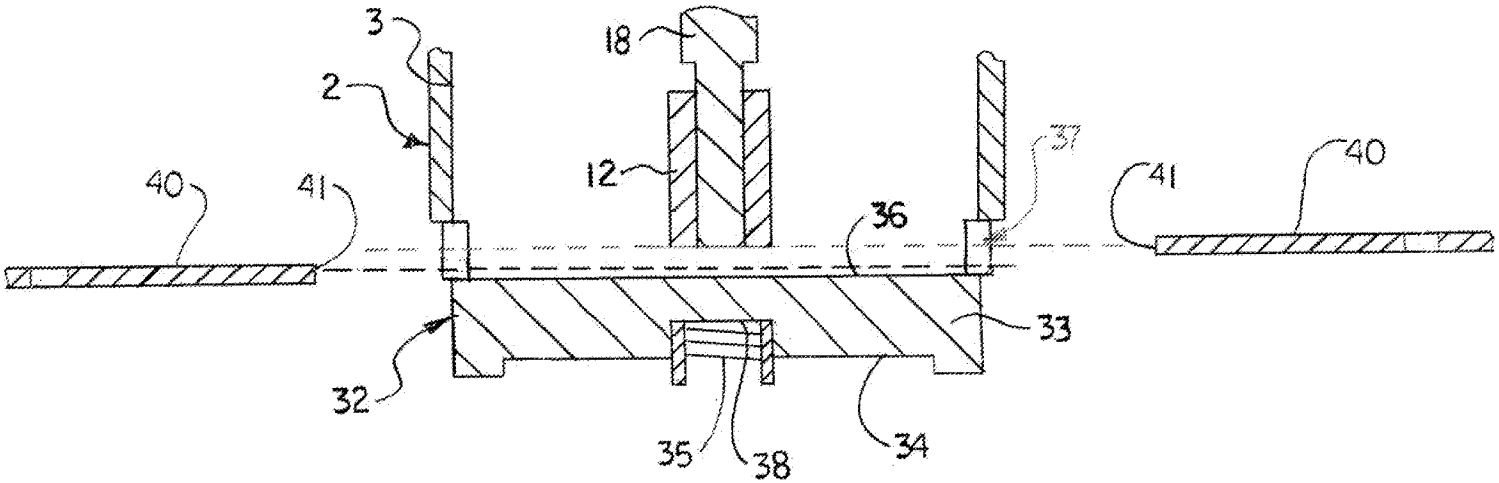
FIG. 12 is an enlarged sectional view of the retainer piston disengaging the shell retention strap in the strap-releasing configuration of the retainer piston.

A retainer piston 18 may be disposed in the trigger housing 2. The retainer piston 18 may be selectively positional in a strap-retaining configuration engaging the shell retention strap 40 (FIG. 9) and a strap-releasing configuration disengaging the shell retention strap 40 (FIG. 10). Accordingly, in the strap-retaining configuration, the retainer piston 18 may be configured to engage the shell retention strap 40 and maintain the interfaceable shell sections 25 of the containment shell 24 in the closed shell configuration. In the strap-releasing configuration, the retainer piston 18 may be configured to disengage the shell retention strap 40 for release of the shell retention strap 40 from the shell retention members 32, 42, disengagement of the shell retention members 32, 42 from the interfaceable shell sections 25 and disengagement of the interfaceable shell sections 25 from each other in deployment of the containment shell 24 to the open shell configuration. As illustrated in FIGS. 9 and 11, in the strap-retaining configuration, the retainer piston 18 may extend through the registering piston openings 44 at or near the respective strap ends 41 of the shell retention strap 40. As illustrated in FIGS. 10 and 12, in the strap-releasing configuration, the retainer piston 18 may disengage the piston openings 44.

Figure 13:
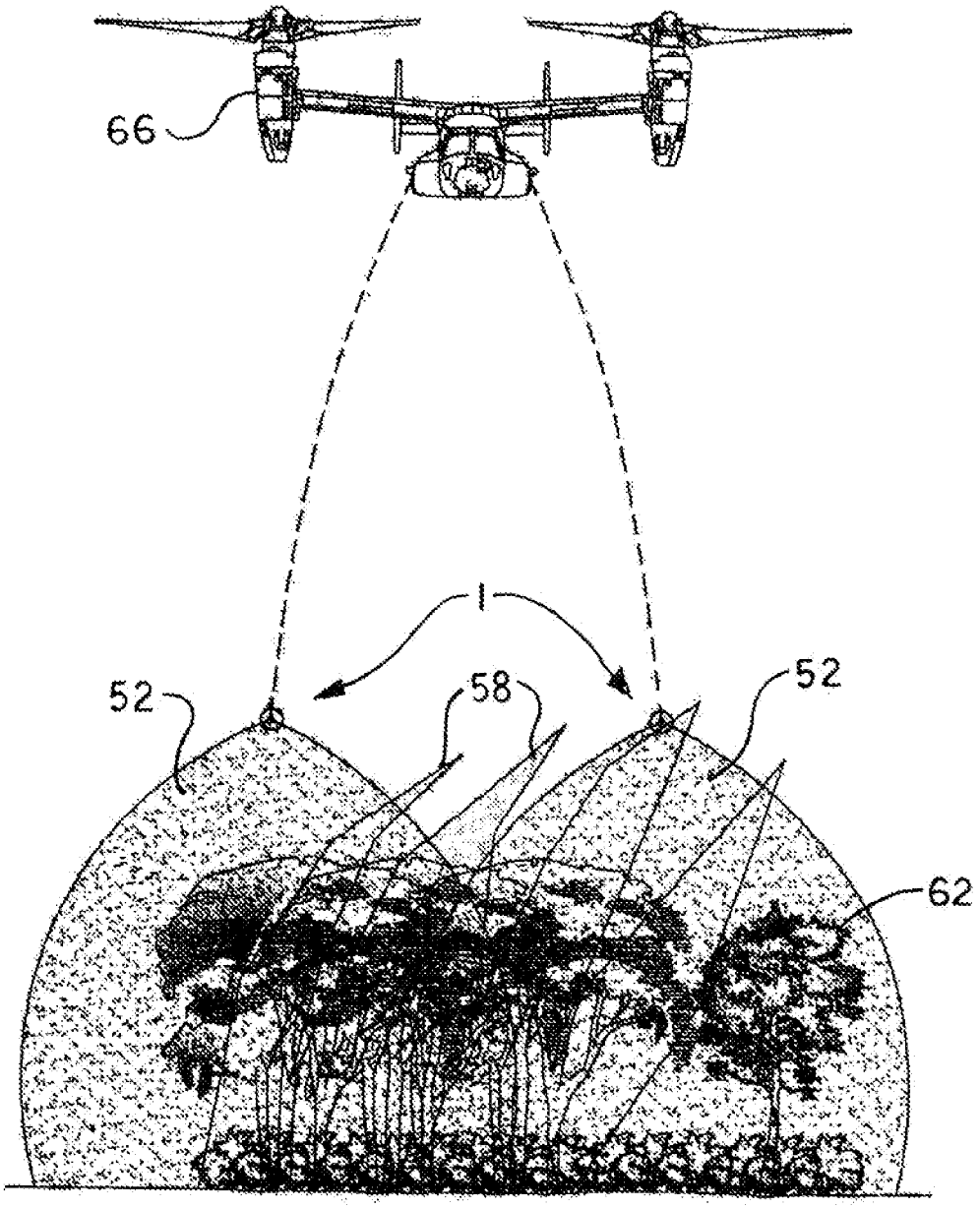
FIG. 13 is a front view of a fire with a deployment aircraft delivering a pair of the firefighting gas releasing apparatuses over the fire as the apparatuses deploy from the closed shell to the open shell configuration and release a fire-suppressing gas which forms a dome-shaped gaseous fog or cloud enclosure over the fire to suppress and extinguish the fire in typical application of the apparatus
Figure 14:
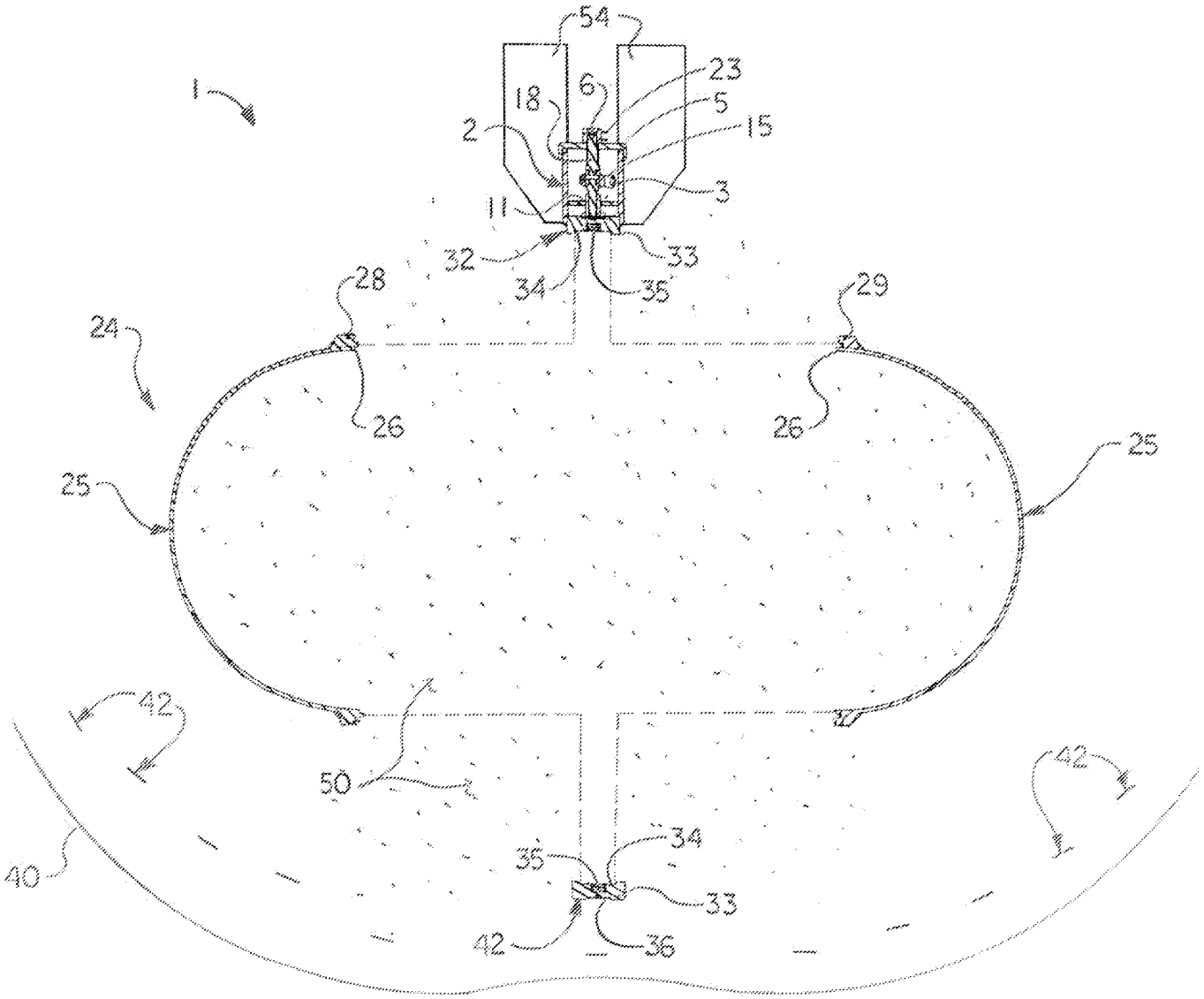
FIG. 14 is a longitudinal sectional view of the illustrative firefighting gas releasing apparatus with the containment shell deployed in a released, open shell configuration.

As illustrated in FIGS. 13 and 14 and will be hereinafter further described, the apparatus 1 may be configured to releasably contain at least one fire-suppressing gas 50 (FIG. 14) such as carbon dioxide, for example and without limitation. At least one apparatus 1 (a pair of which is illustrated in FIG. 13) may be deployed from at least one deployment aircraft 66 over at least a portion of at least one fire 58 to release the fire-suppressing gas 50 over and around the fire 58. The fire-suppressing gas 50 may fall over the fire 58 in a dome-shaped gaseous fog or cloud enclosure 52 which cools and blocks flow of oxygen to the fire 58. Accordingly, the fire 58 may consume the oxygen within the dome-shaped pattern of the gaseous fog or cloud enclosure 52 such that the fire 58 is suppressed and extinguished. In some applications, the deployed apparatus 1 may be retrieved and reused.

Figure 1:
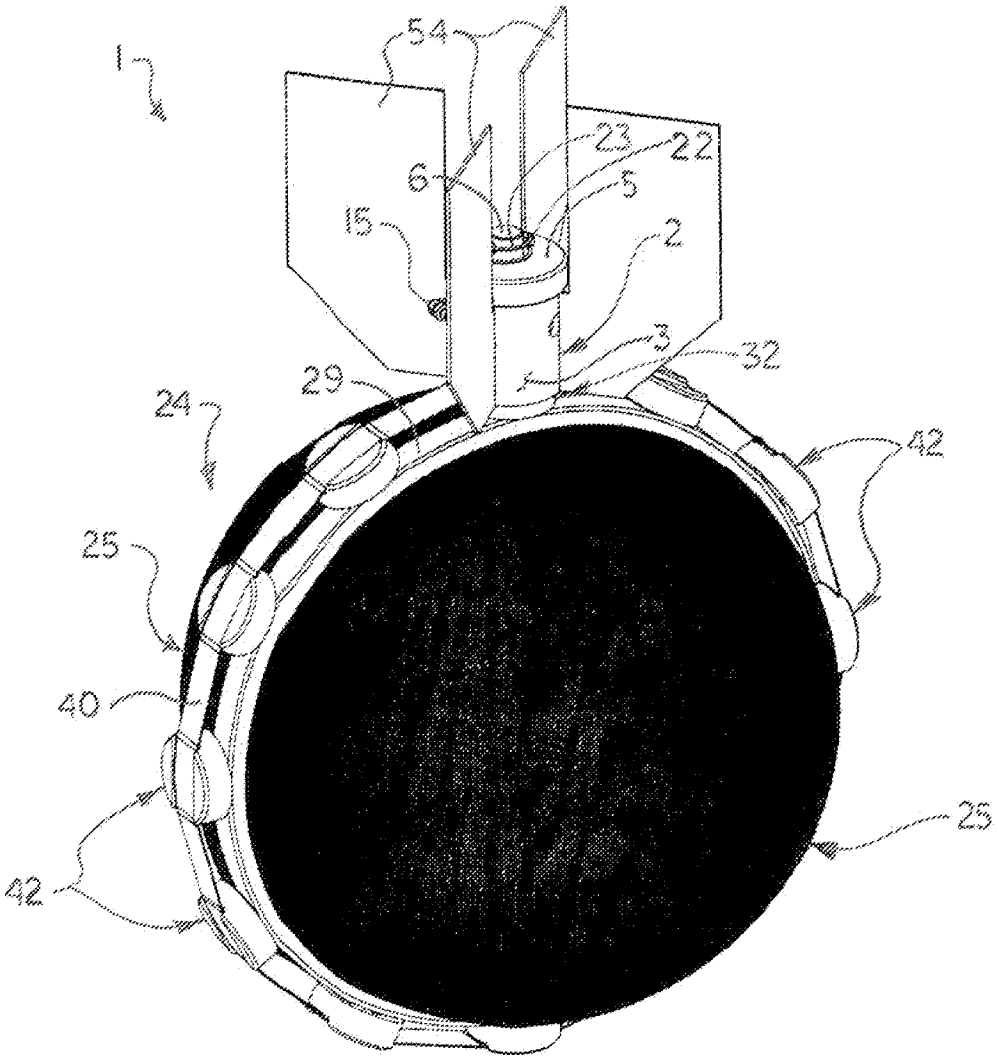
FIG. 1 is a front perspective view of an illustrative embodiment of the firefighting gas releasing apparatuses with the containment shell of the apparatus deployed in the pre-released, closed shell configuration.

The trigger housing 2 may have any design or shape which is consistent with the functional requirements of the trigger housing 2 in the apparatus 1. Accordingly, the trigger housing 2 may have at least one trigger housing sidewall 3. As illustrated in FIG. 1, in some embodiments, the trigger housing sidewall 3 may be continuous and have a cylindrical shape. In other embodiments, the trigger housing 2 may be square or rectangular in top view or cross-section with four trigger housing sidewalls 3 or may have a non-rectangular polygonal shape.

Figure 8:
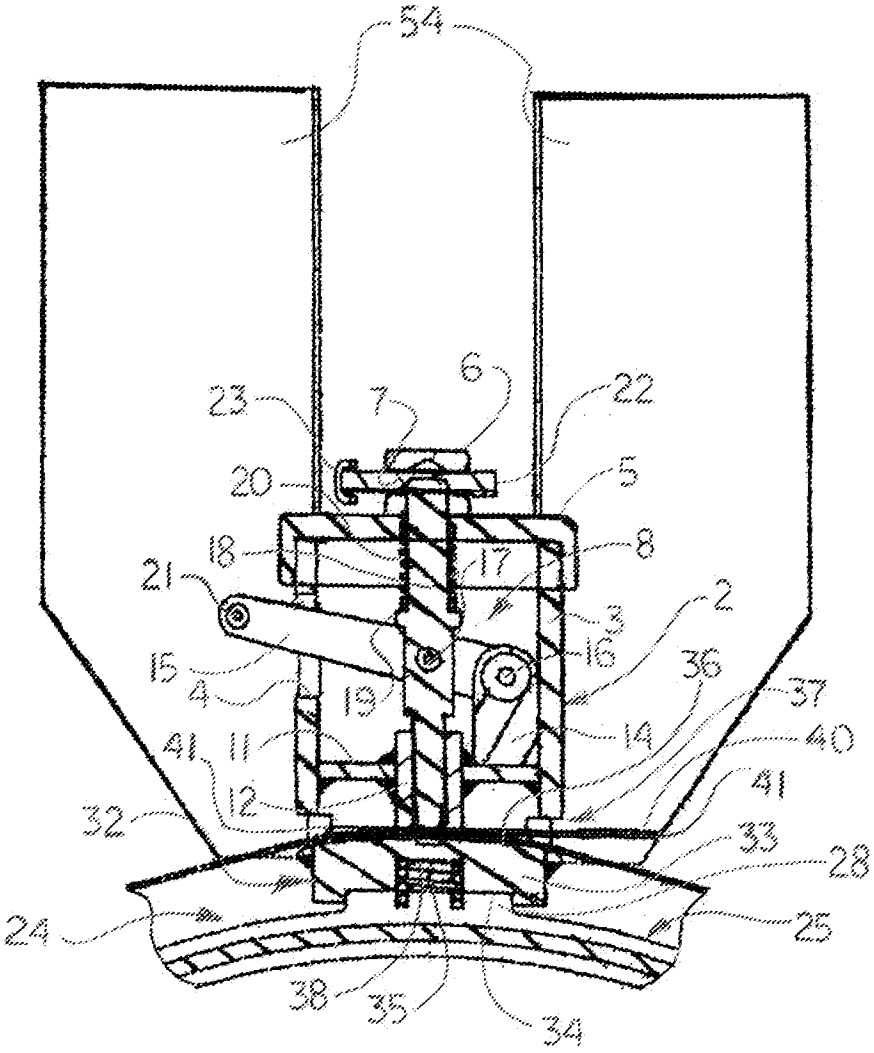
FIG. 8 is an enlarged sectional view of a typical trigger housing, a retainer piston disposed in the trigger housing and a piston release lever engaging the retainer piston according to an illustrative embodiment of the firefighting gas releasing apparatuses.

The trigger housing 2 may have a trigger housing interior 8. As illustrated in FIGS. 8-10, a trigger lever opening 4 may extend through the trigger housing sidewall 3 for purposes which will be hereinafter described. A trigger housing cap 5 may be provided on the trigger housing sidewall 3 to close the trigger housing interior 8. As illustrated in FIGS. 9 and 10, a cap opening 10 may extend through the trigger housing cap 5 for purposes which will be hereinafter described.

A piston housing 6 may be provided on the trigger housing cap 5. The piston housing 6 may communicate with the trigger housing interior 8 of the underlying trigger housing 2 through the cap opening 10 in the trigger housing cap 5. A pin opening 7 may extend transversely through the piston housing 6. The pin opening 7 may be suitably sized and configured to receive a removable piston retainer pin 22, the purposes of which will be hereinafter described. A piston pin retainer 23 may detachably engage the piston retainer pin 22 to maintain the piston retainer pin 22 in place in the pin opening 7.

A lever plate 11 may extend between the trigger housing sidewalls 3 in the trigger housing interior 8. A piston sleeve 12 may extend through a central sleeve opening (not illustrated) in the lever plate 11. The piston sleeve 12 may be disposed substantially in alignment or registration with the cap opening 10 in the trigger housing cap 5.

A retainer piston 18 may be slidably disposed in the trigger housing interior 8 of the rigger housing 2. The retainer piston 18 may be positional in a strap-retaining configuration (FIG. 9) and a strap-releasing configuration (FIG. 10) in the trigger housing interior 8. The retainer piston 18 may extend through the cap opening 10 in the trigger housing cap 5 and through the registering piston sleeve 12 in the lever plate 11. An upper end of the retainer piston 18 may protrude into the piston housing 6. Accordingly, as illustrated in FIG. 10, in the strap-releasing configuration, the retainer piston 18 may seat against the piston housing 6. When deployed in place in the pin opening 7, as illustrated in FIG. 9, the piston retainer pin 22 may prevent the retainer piston 18 from seating against the piston housing 6 and maintain the retainer piston 18 in the strap-retaining configuration until deployment of the apparatus 1.

A piston flange 19 may extend circumferentially from the retainer piston 18. A coiled piston spring 20 may be interposed between the piston flange 19 and the trigger housing cap 5 of the trigger housing 2. Accordingly, the piston spring 20 may normally bias the retainer piston 18 in the strap-retaining configuration illustrated in FIG. 9.

A piston release lever 15 may be pivotally mounted with respect to the trigger housing 2 and pivotally attached to the retainer piston 18. Accordingly, the piston release lever 15 may be configured to facilitate selective release of the retainer piston 18 from the strap retaining configuration in FIG. 9 to the strap releasing configuration illustrated in FIG. 10. In some embodiments, a lever mount 14 may extend from the lever plate 11 into the trigger housing interior 8. The piston release lever 15 may have a proximal end pivotally attached to the lever mount 14 via a lever pivot 16. The distal end of the piston release lever 15 may extend from the trigger housing interior 8 through the trigger lever opening 4 in the trigger housing sidewall 3. A lever attachment 21 may be provided at the distal end of the piston release lever 15 typically for purposes which will be hereinafter described.

The piston release lever 15 may be pivotally attached to the retainer piston 18 via a piston pivot 17 between the lever pivot 16 and the lever attachment 21. Accordingly, as it pivots with respect to the lever pivot 16 and the piston pivot 17, the piston release lever 15 may be selectively operable to deploy the retainer piston 18 from the strap-retaining configuration illustrated in FIG. 9 to the strap-releasing configuration illustrated in FIG. 10, typically against the bias imparted by the piston spring 20 on the retainer piston 18. In deployment of the apparatus 1, a lever actuation line (not illustrated) may be attached to the lever attachment 21 to facilitate remote actuation of the piston release lever 15, such as from the aircraft 66 (FIG. 13), for example and without limitation.

An openable containment shell 24, having a shell interior 30, as illustrated in FIG. 5, may extend from the trigger housing 2. The containment shell 24 may include multiple interfaceable shell sections 25. In some embodiments, a pair of hemispherical shell sections 25 may interface with each other to form the containment shell 24. The shell sections 25 may be deployable from the assembled, closed shell configuration illustrated in FIG. 5 to the disassembled, open shell configuration illustrated in FIG. 14 typically as will be hereinafter described. In the closed shell configuration, the shell interior 30 of the containment shell 24 is configured to contain a supply of the fire-suppressing gas 50, as illustrated in FIG. 5. In the open shell configuration, the shell interior 30 is configured to release the fire-suppressing gas 50, as illustrated in FIG. 14.

A primary shell retention member 32 may attach the shell sections 25 of the containment shell 24 to the trigger housing 2. As illustrated in FIG. 8, the primary shell retention member 32 may include a shell retention member body 33, which may be disc shaped. The shell retention member body 33 may extend from or may be attached to or fabricated in one piece with and in spaced-apart relationship with respect to the trigger housing sidewall 3 of the trigger housing 2 according to the knowledge of those skilled in the art. A strap slot 37 may be formed by and between the trigger housing sidewall 3 of the trigger housing 2 and the shell retention member body 33 of the primary shell retention member 32. A shell retention cavity 34 may extend into the shell retention member body 33 opposite the strap slot 37. A release spring 35 may interface with the shell retention cavity 34. The release spring 35 may be disposed in a spring cavity 38 which extends into the shell retention member body 33 and communicates with the shell retention cavity 34.

A strap recess 36 may be provided in the shell retention member body 33 opposite the shell retention cavity 34 and in communication with the strap slot 37. The strap recess 36 may be suitably sized and configured to receive the shell retention strap 40 as the strap ends 41 of the shell retention strap 40 are extended through the strap slot 37 and deployed in place by deployment of the retainer piston 18 in the strap-retaining configuration to secure the shell sections 25 of the containment shell 24 in the closed shell configuration.

Figure 6:
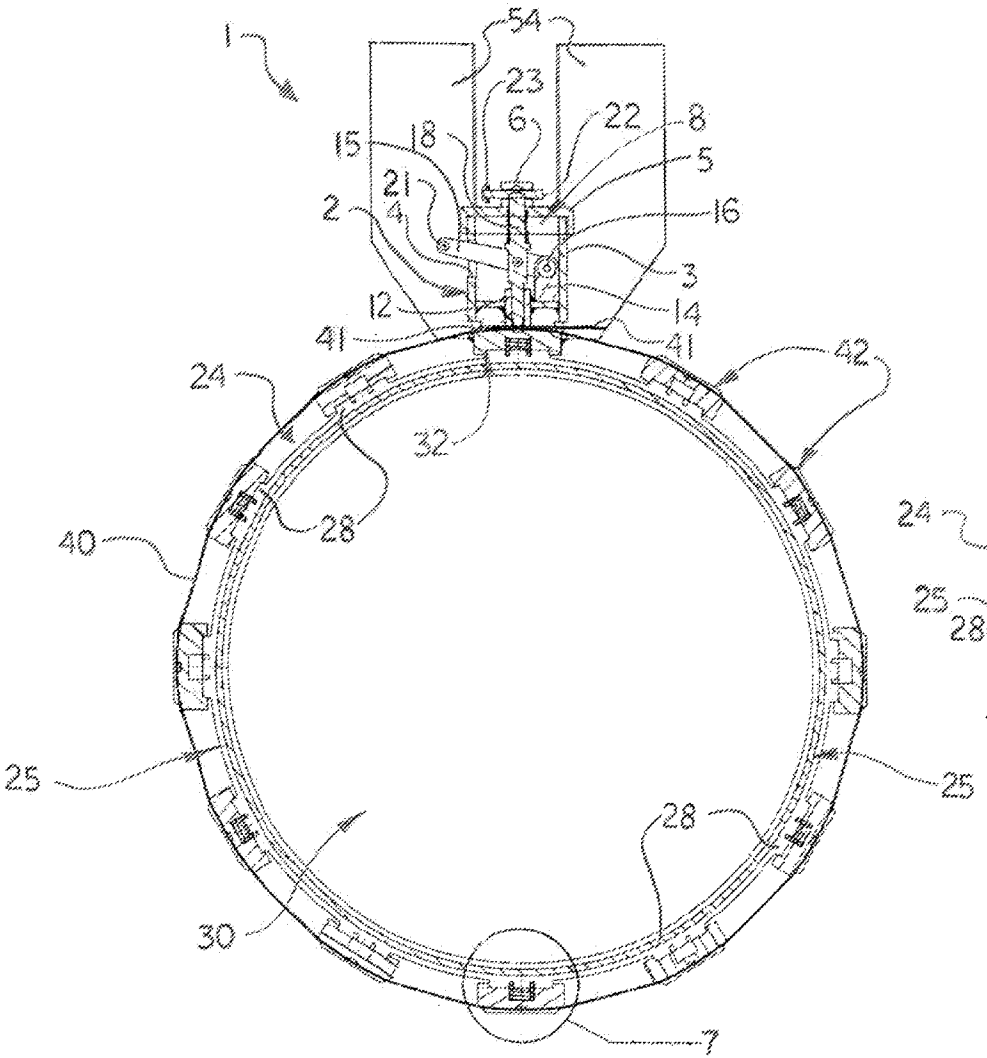
FIG. 6 is a sectional view, taken along section lines 6-6 in FIG. 4, of the trigger housing and containment shell of the illustrative firefighting gas releasing apparatus.

Multiple secondary shell retention members 42 may secure and maintain the shell sections 25 in the closed shell configuration of the containment shell 24. As illustrated in FIG. 6, each secondary shell retention member 42 may have a design which is the same as or similar to that of the primary shell retention member 32, with a typically disc-shaped shell retention member body 33; a shell retention cavity 34 and a strap recess 36 in the opposite surfaces of the shell retention member body 33; a spring cavity 38 interfacing with the shell retention cavity 34; and a release spring 35 disposed in the spring cavity 38.

Figure 3:
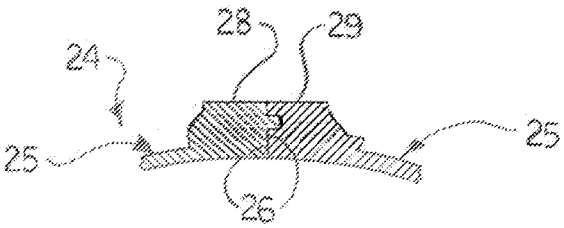
FIG. 3 is a cross-sectional view, taken along section line 3-3 in FIG. 2, of interfacing male and female shell retention flanges on a pair of hemispherical shell sections, respectively, in the pre-released, closed shell configuration of the containment shell.
Figure 2:
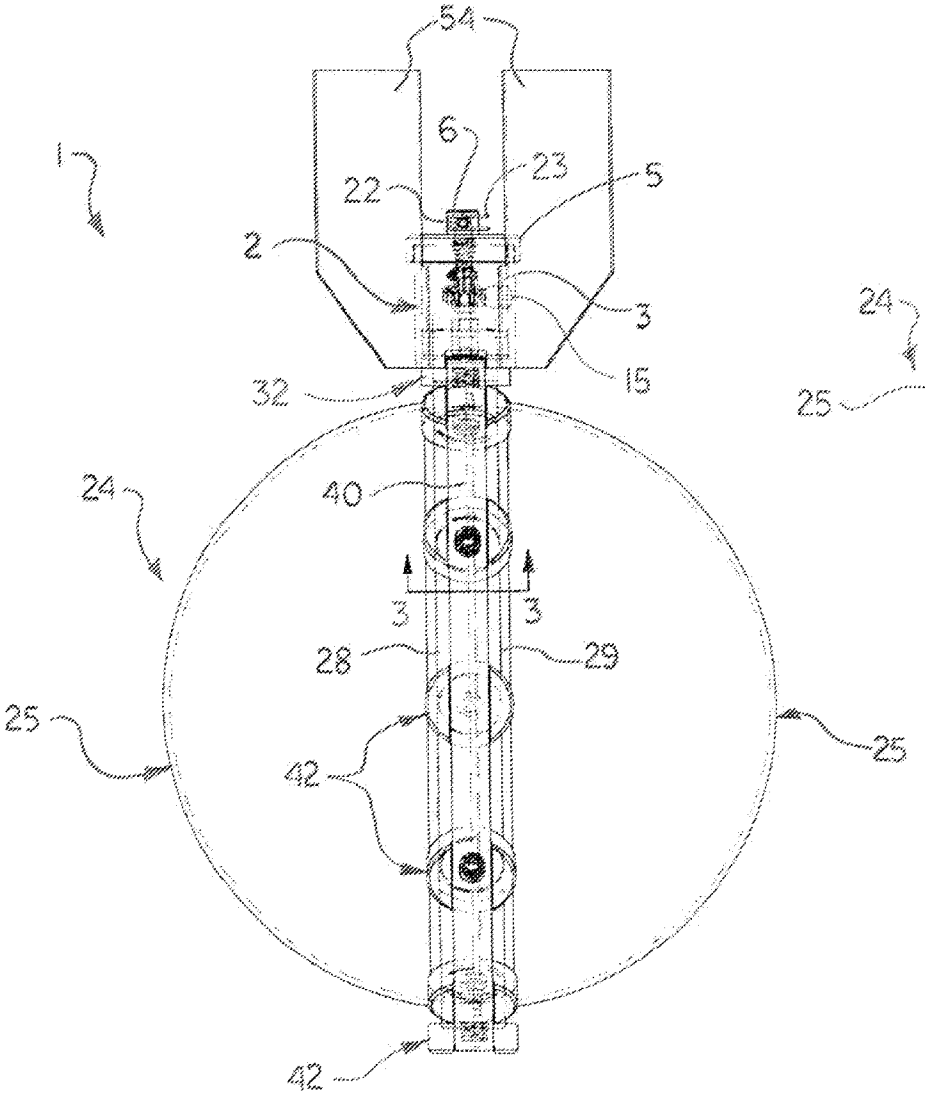
FIG. 2 is a front view, taken along viewing lines 2-2 in the top view of FIG. 4, of the illustrative firefighting gas releasing apparatus illustrated in FIG. 1.
Figure 4:
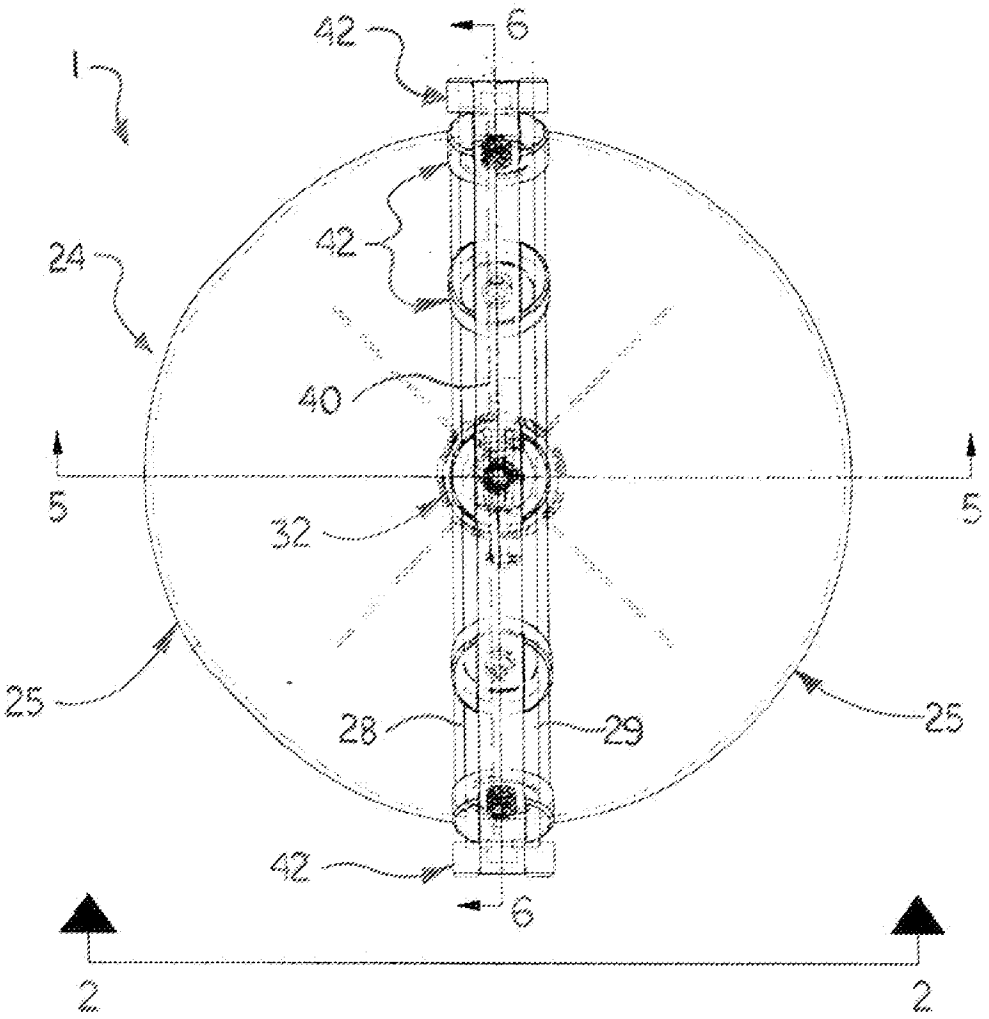
FIG. 4 is a top view of the illustrative firefighting gas releasing apparatus.

In the closed shell configuration of the containment shell 24, the shell sections 25 may be attached to the trigger housing sidewall 3 of the trigger housing 2 via the primary shell retention member 32. The secondary shell retention members 42 may engage the shell sections 25 and the shell retention strap 40 may releasably engage the primary shell retention member 32 and the secondary shell retention members 42 to maintain the containment shell 24 in the closed shell configuration until deployment of the apparatus 1. As illustrated in FIGS. 3 and 14, each shell section 25 may have a shell section edge 26. Multiple, semicircular male shell retention flanges 28 may extend in spaced-apart relationship to each other from the shell section edge 26 of one shell section 25. Multiple, semicircular female shell retention flanges 29 which correspond positionally with the respective male shell retention flanges 28 may extend along the shell section edge 26 of the opposite, interfacing shell section 25. The male shell retention flanges 28 may insert into the respective companion female shell retention flanges 29 to form a fluid-tight seal between the shell sections 25 in the closed shell configuration of the containment shell 24.

Figure 7:
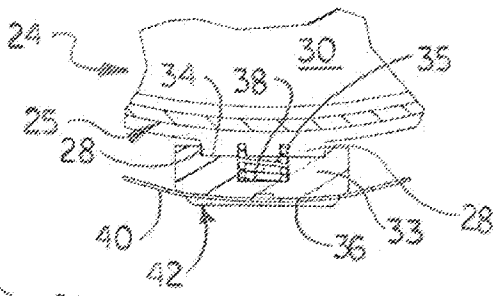
FIG. 7 is an enlarged sectional view, taken along section line 7 in FIG. 6, of a typical shell retention member and a shell retention strap engaging the shell retention member, with the shell retention member and shell retention strap retaining the containment shell in the pre-released, closed shell configuration of the illustrative firefighting gas releasing apparatus.

In attachment of the interfacing shell sections 25 in assembly of the containment shell 24, the secondary shell retention members 42 may be disposed in spaced-apart relationship to each other and with respect to the primary shell retention member 32 at the respective male shell retention flanges 28 and interlocking female shell retention flanges 29 which are spaced-apart with respect to each other along the interfacing shell section edges 26 of the shell sections 25. As illustrated in FIGS. 6 and 8, one male shell retention flange 28 and its interlocking female shell retention flange 29 on the respective shell sections 25 may insert into the shell retention cavity 34 of the primary shell retention member 32. In like manner, as illustrated in FIGS. 6 and 7, the shell retention cavity 34 of each secondary shell retention member 42 may receive the corresponding male shell retention flange 28 and its interfacing female shell retention flange 29. The release spring 35 of the primary shell retention member 32 may engage the male shell retention flange 28 and female shell retention flange 29 and bias the primary shell retention member 32 away from the shell sections 25 of the containment shell 24 in a shell-disengaging position of the primary shell retention member 32. In like manner, the release spring 35 of each secondary shell retention member 42 may engage each corresponding male shell retention flange 28 and its interlocking female shell retention flange 29 and bias each corresponding secondary shell retention member 42 away from the shell sections 25 in a shell-disengaging position of each secondary shell retention member 42.

The shell retention strap 40 may be deployed in place by inserting the shell retention strap 40 into the strap recesses 36 of the respective secondary shell retention members 42. The overlapping strap ends 41 of the shell retention strap 40 may be inserted through the strap slot 37 into the strap recess 36 of the primary shell retention member 32. The retainer piston 18 may be deployed from the strap-releasing configuration illustrated in FIGS. 10 and 12 to the strap-retaining configuration illustrated in FIGS. 9 and 11 typically by actuation of the piston release lever 15. Accordingly, the retainer piston 18 may extend through the registering piston openings 44 at or near the respective strap ends 41 of the shell retention strap 40 and engage the underlying shell member body 33 of the primary shell retention member 32 to retain the shell retention strap 40 against the primary shell retention member 32 and the secondary shell retention members 42 in a shell-engaging position against the bias imparted by the respective release springs 35. The piston retainer pin 22 may be deployed in place in the pin opening 7 in the piston housing 6 to maintain the retainer piston 18 in the strap-retaining configuration. The piston pin retainer 23 may be deployed to retain the piston retainer pin 22 in the pin opening 7.

In some embodiments, multiple tail fins 54 may extend from the trigger housing 2 opposite the containment shell 24. The tail fins 54 may be configured to guide the falling apparatus 1 to the desired area above the fire 58 (FIG. 13) and facilitate vertical alignment as the apparatus 1 is deployed from the deployment aircraft 66, as illustrated in FIG. 13 and will be hereinafter described.

The trigger housing 2 and its components, the shell sections 25 of the containment shell 24, the primary shell retention member 32, the secondary shell retention members 42 and the tail fins 54 may be fabricated of a metal such as stainless steel, for example and without limitation, and/or other suitable materials such as high-density plastics and composite materials. The shell retention strap 40 may be fabricated of nylon and/or other synthetic polymer material or materials. The trigger housing 2 may include provisions or features for placing the fire-suppressing gas 50 in the shell interior 30 of the containment shell 24. For example and without limitation, in some embodiments, at least one filling port (not illustrated) through which the fire-suppressing gas 50 can be introduced into the shell interior 30.

The lever attachment 21 on the piston release lever 15 may also include the required components necessary for attachment of a control line (not illustrated) to the piston release lever 15 for deployment of the piston release lever 15 from the strap-retaining configuration illustrated in FIG. 9 to the strap-releasing configuration illustrated in FIG. 10 in deployment of the apparatus 1, according to the knowledge of those skilled in the art. In some embodiments, actuation of the piston release lever 15 may be remote-controlled through transmission of RF (Radio Frequency) or other signals. In other embodiments, the actuation component or components may be hardwired to a control module which may be contained in the deployment aircraft 66. The control wiring (not illustrated) may extend along a retrieval line or cable (not illustrated) which may connect the apparatus 1 to the deployment aircraft 66 for retrieval of the apparatus 1 after use, as will be hereinafter further described.

In typical application, at least one apparatus 1 may be deployed from at least one deployment aircraft 66 over at least a portion of at least one fire 58 to suppress and extinguish the fire 58, as illustrated in FIG. 13. In some applications, the fire 58 may be a forest fire or wildfire which consumes trees, brush, grass and/or other vegetation 62, and may additionally or alternatively consume homes, offices and/or other buildings. Accordingly, the fire 58 may cover a large area in an urban and/or rural setting. In other applications, the fire 58 may be more limited in area.

The deployment aircraft 66 may include any type of aerial vehicle which is suitable for flying over the fire 58 and dropping or deploying the apparatus 1 above the fire 58. Non-limiting examples of deployment aircraft 66 which may be suitable for the purpose include both manned and unmanned helicopters, airplanes and balloons and rockets and drones. The particular size and type of deployment aircraft 66 which is used for a particular application may depend on such factors as the size or extent of the fire 58, fire intensity or accessibility and the size and weight of the apparatus 1. One type of deployment aircraft 66 which may be suitable for some applications includes the BELL™ BOEING™ V-22 Osprey aircraft. The Osprey is a type of twin-engine tilt-rotor VTOL (Vertical Takeoff and Landing) aircraft with exceptional maneuvering characteristics.

The apparatus 1 may be prepared for deployment by initially assembling the shell sections 25 in the closed shell configuration of the containment shell 24 illustrated in FIGS. 1, 2 and 4-6. Accordingly, as illustrated in FIGS. 3 and 5, the male shell retention flanges 28 on one shell section 25 may initially be inserted in the respective companion female shell retention flanges 29 on the adjacent shell section 25. The secondary shell retention members 42 may be deployed in place on the respective pairs of interlocking male shell retention flanges 28 and female shell retention flanges 29.

The shell retention strap 40 may be deployed in place against the primary shell retention member 32 and the secondary shell retention members 42. As illustrated in FIGS. 10 and 12, the strap ends 41 of the shell retention strap 40 may be inserted through the strap slot 37 and the strap recess 36 of the primary shell retention member 32. As the strap ends 41 are pulled in opposite directions, the shell retention strap 40 may tighten against the primary shell retention member 32 and each secondary shell retention member 42, thus deploying the primary shell retention member 32 and the secondary shell retention members 42 from the shell-disengaging position to the shell-engaging position against the bias imparted by the release springs 35. By actuation of the piston release lever 15, the retainer piston 18 may be deployed from the strap-releasing position in FIGS. 10 and 12 to the strap-retaining position illustrated in FIGS. 9 and 11, such that the retainer piston 18 extends through the registering piston openings 44 in the shell retention strap 40. As illustrated in FIG. 10, the piston retainer pin 22 may be inserted into the pin opening 7 in the piston housing 6 to engage and retain the retainer piston 18 in the strap-retaining position. The piston pin retainer 23 may be deployed in place to retain the piston retainer pin 22 in the pin opening 7.

A supply of the fire-suppressing gas 50 may be placed in the shell interior 29 of the containment shell 24. The fire-suppressing gas 50 may include at least one inert gas which can be released from the containment shell 24 to form a dome-shaped gaseous fog or cloud enclosure 52 (FIG. 13) over at least a portion of the fire 58 which cools, suppresses and extinguishes the fire 58. In some embodiments, the tire-suppressing gas 50 may include a combination of inert gases. For example and without limitation, the fire-suppressing gas 50 may include gaseous or supercritical carbon dioxide alone or in combination with one or more other inert gases such as nitrogen and/or argon. A gas supply (not illustrated) which contains the fire-suppressing gas 50 in a compressed or supercritical form may be coupled to the filling port (not illustrated) on the containment shell 24. The fire-suppressing gas 50 may be introduced through the filling port and into the shell interior 29 of the closed containment shell 24. When the shell interior 29 contains the desired quantity or volume of the fire-suppressing gas 50, the gas supply may be uncoupled from the filling port. In some embodiments, a unidirectional valve (not illustrated) may be included in the filling port to prevent escape of the fire-suppressing gas 50 from the shell interior 29.

The apparatus 1 may be placed in the deployment aircraft 66 (FIG. 13) preparatory to deployment of the apparatus 1 over the fire 58. The lever actuation line (not illustrated) may be attached to the lever attachment 21 on the piston release lever 15 to facilitate remote actuation of the retainer piston 18 via actuation of the piston release lever 15, such as from the aircraft 66 (FIG. 13), for example and without limitation. After the deployment aircraft 66 is maneuvered in place over the fire 58, the piston retainer pin 22 may be removed from the pin opening 7 in the piston housing 6. The apparatus 1 may be dropped from the aircraft over the fire 58. As the apparatus 1 falls from the deployment aircraft 66, the tail fins 54 may facilitate vertical alignment of the apparatus 1 and guide the apparatus 1 to the desired area above the fire 58.

Before the apparatus 1 reaches the top of the fire 58, the falling motion of the apparatus 1 may cause the length of the lever actuation line to be expended, whereupon the lever actuation line pulls the piston release lever 15 and deploys the retainer piston 18 from the strap-retaining configuration, as illustrated in FIGS. 9 and 11, to the strap-releasing configuration, as illustrated in FIGS. 10 and 12, against the bias imparted by the piston spring 20. The retainer piston 18 disengages the piston openings 44 and releases the shell retention strap 40. The released shell retention strap 40 may release and disengage the primary shell retention member 32 and the secondary shell retention members 42 such that each release spring 35 deploys each corresponding primary shell retention member 32 and secondary shell retention member 42 from the shell-engaging position to the shell-disengaging position. Accordingly, as illustrated in FIG. 14, the male shell retention flange 28 and corresponding interlocking female shell retention flange 29 are released from the shell retention cavity 34 of the primary shell retention member 32 via the release spring 35. Simultaneously, the secondary shell retention members 42 are released from their respective male shell retention flanges 28 and interlocking female shell retention flanges 29 via the respective release springs 35 such that the shell sections 25 fall away from the trigger housing 2 and the secondary shell retention members 42 fall away from the shell sections 25 along with the shell retention strap 40. The male shell retention flanges 28 disengage the respective female shell retention flanges 29, and the disengaged shell sections 25 move away from each other.

The fire-suppressing gas 50 escapes the shell interior 29 of the containment shell 24, as illustrated in FIG. 14, and falls over the fire 58 in the dome-shaped gaseous fog or cloud enclosure 52, as illustrated in FIG. 13. Accordingly, the gaseous fog or cloud enclosure 52 encapsulates and blocks flow of oxygen to the fire 58 as the fire 58 continues to consume the oxygen within the dome-shaped pattern of the gaseous fog or cloud enclosure 52, suppressing and extinguishing the fire 58. In some applications, particularly in the case of larger fires 58, it may be required that several apparatuses 1 be deployed over the fire 58, either in a single pass, as illustrated in FIG. 6, or multiple passes, until the fire 58 is extinguished.

It will be appreciated by those skilled in the art that the firefighting gas releasing apparatus of the disclosure contains carbon dioxide and/or other fire-suppressing gas in a delivery system which assures safe delivery with no shrapnel effects and minimal damage to the terrain and general environment with minimal release of carbon dioxide and/or other inert gases into the atmosphere. The firefighting gas releasing apparatus and method makes use of advancements in weapons technology utilizing carbon dioxide to achieve an efficient, effective, social and environmental benefit. The outcome may save human lives, wildlife lives and injury and preserve property while minimizing and reducing the overall effect of released gases on the environment. A desirable effect of using carbon dioxide to fight wildfires is the potential elimination of chemical retardants. Use of carbon dioxide in the extinguishing of wildfires may reduce or stop the massive discharge of fire-generated carbon dioxide into the environment as well as the release of other carbon products into the soil and atmosphere.

The containment shell 24, trigger housing 2 and other components of the apparatus 1 may be fabricated in different sizes depending typically on the quantity of volume of fire-suppressing gas 50 which is to be delivered to the fire 58. While some applications of the firefighting gas releasing method contemplate the use of a deployment aircraft 66 to drop the apparatus 1 over the fire 58, the present disclosure contemplates other methods of deployment such as delivery of the apparatus 1 over the fire 58 using a rocket-propelled or hand-grenade type delivery system, for example and without limitation.

In some applications, a heavy, slow-moving deployment aircraft 66 may be used to carry a large payload in the form of one or more of the apparatuses 1. The apparatuses 1 may be deployed over the fire 58 in a "carpet bomb" strategy. This may spread the apparatuses 1 uniformly along the fire 58 to provide cooling and maximize oxygen displacement. Deployment of the apparatuses 1 may begin at the downwind end of the fire 58 and proceed successively toward those areas which have already been consumed.

Figure 15:
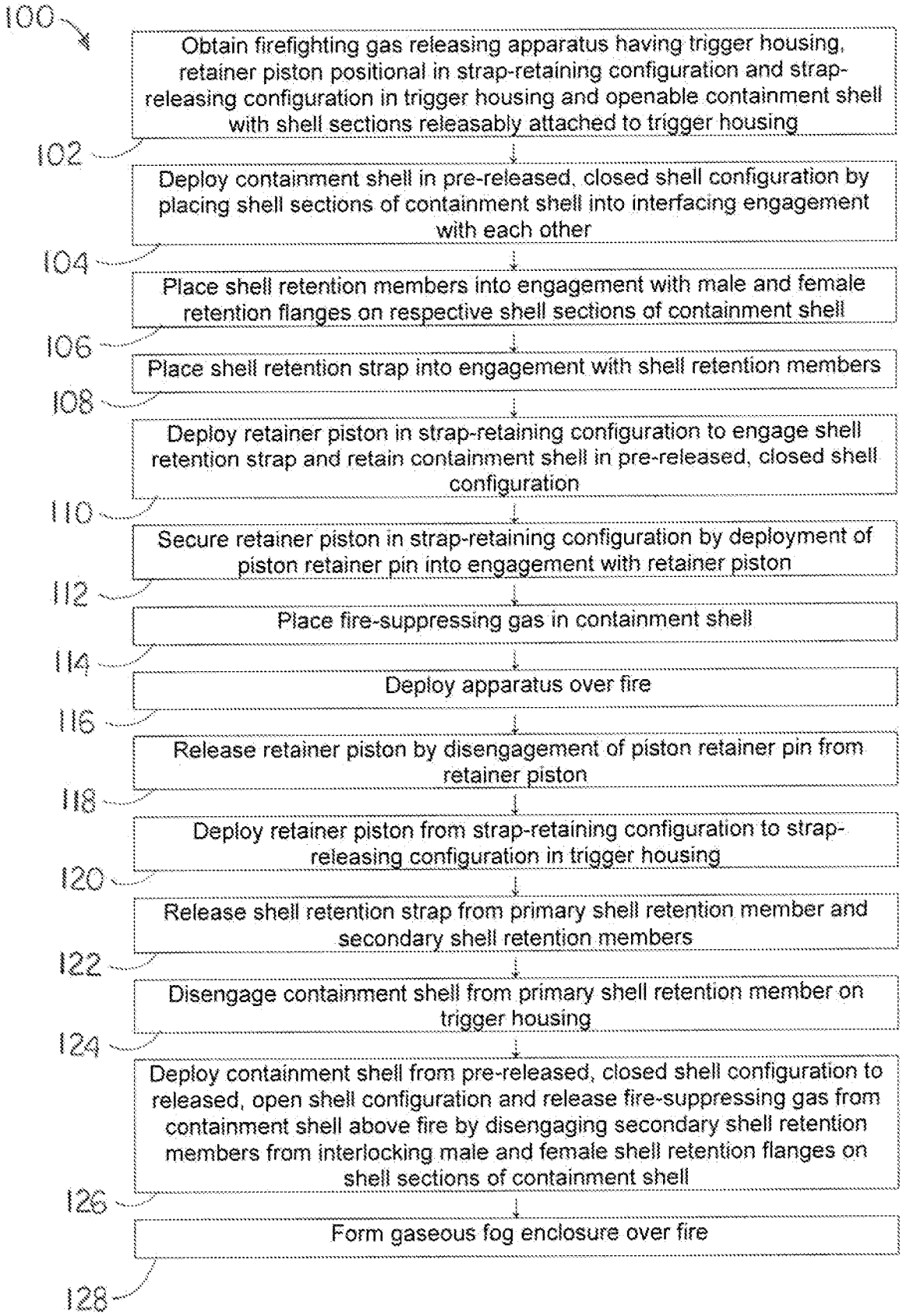
FIG. 15 is a flow diagram of an illustrative embodiment of the firefighting gas releasing methods.

Referring next to FIG. 15 of the drawings, a flow diagram of an illustrative embodiment of the firefighting gas releasing method is generally indicated by reference numeral 100. At Step 102, at least one firefighting gas releasing apparatus may be obtained. The firefighting gas releasing apparatus may include a trigger housing, a retainer piston positional in a strap-retaining configuration and a strap-releasing configuration in the trigger housing, and an openable containment shell with shell sections releasably attached to the trigger housing.

At Step 104, the containment shell may be deployed in an assembled, pre-released, closed shell configuration by placing the shell sections of the containment shell into interfacing engagement with each other.

At Step 106, shell retention members may be placed into engagement with the interlocking male and female retention flanges on the respective shell sections of the containment shell.

At Step 108, a shell retention strap may be placed into engagement with the shell retention members.

At Step 110, the retainer piston may be deployed in a strap-retaining configuration to engage the shell retention strap and retain the containment shell in the pre-released, closed shell configuration.

At Step 112, the retainer piston may be secured in the strap-retaining configuration by deployment of a piston retainer pin into engagement with the retainer piston.

At Step 114, a fire-suppressing gas may be placed in the shell interior of the containment shell.

At Step 116, the apparatus may be deployed over at least one fire.

At Step 118, the retainer piston may be released in the trigger housing by disengagement of the piston retainer pin from the retainer piston.

At Step 120, the retainer piston may be deployed from the strap-retaining configuration to the strap-releasing configuration in the trigger housing.

At Step 122, the shell retention strap may be released from the primary shell retention member and the secondary shell retention members.

At Step 124, the containment shell may be disengaged from the primary shell retention member on the trigger housing.

At Step 126, the containment shell may be deployed from the pre-released, closed shell configuration to the released, open shell configuration and fire-suppressing gas released from the containment shell above the fire by disengaging the secondary shell retention members from the interlocking male and female shell retention flanges on the shell sections of the containment shell.

At Step 128, a gaseous fog enclosure may be formed over the fire.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A firefighting gas releasing apparatus, comprising:

a trigger housing;

a containment shell having a pair of interfaceable hemispherical shell sections carried by the trigger housing, the pair of interfaceable hemispherical shell sections positional in a closed shell configuration and an open shell configuration;

a shell interior formed by the pair of interfaceable hemispherical shell sections in the closed shell configuration, the shell interior configured to contain a supply of at least one fire-suppressing gas;

a plurality of male shell retention flanges extending in spaced-apart relationship to each other from a first one of the pair of interfaceable hemispherical shell sections;

a plurality of female shell retention flanges extending in spaced-apart relationship to each other from a second one of the pair of interfaceable hemispherical shell sections, the plurality of male shell retention flanges configured to insert into the plurality of female shell retention flanges, respectively, to form a plurality of paired interlocking shell retention flanges imparting a fluid-tight seal between the pair of interfaceable hemispherical shell sections in the closed shell configuration;

a plurality of shell retention members removably engaging the plurality of paired interlocking shell retention flanges;

a shell retention strap releasably engaging the plurality of shell retention members, the shell retention strap and the plurality of shell retention members retaining the pair of interfaceable hemispherical shell sections in the closed shell configuration;

a retainer piston disposed in the trigger housing, the retainer piston selectively positional in a strap-retaining configuration engaging the shell retention strap and a strap-releasing configuration disengaging the shell retention strap; and the retainer piston configured to engage the shell retention strap and maintain the pair of interfaceable hemispherical shell sections of the containment shell in the closed shell configuration and disengage the shell retention strap for release of the shell retention strap from the plurality of shell retention members, disengagement of the plurality of shell retention members from the pair of interfaceable hemispherical shell sections and disengagement of the pair of interfaceable hemispherical shell sections from each other in deployment of the containment shell to the open shell configuration.

2. The firefighting gas releasing apparatus of claim 1 wherein the plurality of shell retention members comprises a primary shell retention member carried by the trigger housing and a plurality of secondary shell retention members disposed in spaced-apart relationship to the primary shell retention member and to each other.

3. The firefighting gas releasing apparatus of claim 1 wherein the plurality of shell retention members comprises a shell retention member wall; a shell retention cavity configured to receive the pair of interfaceable hemispherical shell sections of the containment shell; and a strap recess configured to receive the shell retention strap.

4. The firefighting gas releasing apparatus of claim 1 further comprising a piston spring engaging and biasing the retainer piston in the strap-retaining configuration.

5. A firefighting gas releasing apparatus, comprising:

a trigger housing;

a containment shell having a plurality of interfaceable shell sections carried by the trigger housing, the plurality of interfaceable shell sections positional in a closed shell configuration and an open shell configuration, a shell interior formed by the plurality of interfaceable shell sections in the closed shell configuration, the shell interior configured to contain a supply of at least one fire-suppressing gas;

a plurality of shell retention members removably engaging the plurality of interfaceable shell sections;

a shell retention strap releasably engaging the plurality of shell retention members, the shell retention strap and the plurality of shell retention members retaining the plurality of interfaceable shell sections in the closed shell configuration;

a retainer piston disposed in the trigger housing, the retainer piston selectively positional in a strap-retaining configuration engaging the shell retention strap and a strap-releasing configuration disengaging the shell retention strap; and the retainer piston configured to engage the shell retention strap and maintain the plurality of interfaceable shell sections of the containment shell in the closed shell configuration and disengage the shell retention strap for release of the shell retention strap from the plurality of shell retention members, disengagement of the plurality of shell retention members from the plurality of interfaceable shell sections and disengagement of the plurality of interfaceable shell sections from each other in deployment of the containment shell to the open shell configuration;

a piston spring engaging and biasing the retainer piston in the strap-retaining configuration; and a piston release lever pivotally carried by the trigger housing and pivotally engaging the retainer piston, the piston release lever configured to facilitate deployment of the retainer piston from the strap-retaining configuration to the strap-releasing configuration.

6. The firefighting gas releasing apparatus of claim 1 wherein the trigger housing comprises a trigger housing side wall, a trigger housing cap on the trigger housing side wall, a piston housing on the trigger housing cap, a pin opening in the piston housing and a piston retainer pin removably disposed in the pin opening, the piston retainer pin configured to engage and maintain the retainer piston in the strap-retaining configuration.

7. A firefighting gas releasing apparatus, comprising:

a trigger housing;

a containment shell having a pair of interfaceable hemispherical shell sections carried by the trigger housing, the pair of interfaceable hemispherical shell sections positional in a closed shell configuration and an open shell configuration;

a shell interior formed by the pair of interfaceable hemispherical shell sections in the closed shell configuration, the shell interior configured to contain a supply of at least one fire-suppressing gas;

a plurality of male shell retention flanges extending in spaced-apart relationship to each other from a first one of the pair of interfaceable hemispherical shell sections;

a plurality of female shell retention flanges extending in spaced-a relationship to each other from a second one of the pair of interfaceable hemispherical shell sections, the plurality of male shell retention flanges configured to insert into the plurality of female shell retention flanges, respectively, to form a plurality of paired interlocking shell retention flanges imparting a fluid-tight seal between the pair of interfaceable hemispherical shell sections in the closed shell configuration;

a plurality of shell retention members removably engaging the plurality of paired interlocking shell retention flanges, respectively, the plurality of shell retention members positional in a shell-engaging position and a shell-disengaging position;

a plurality of release springs engaging and biasing the plurality of shell retention members, respectively, in the shell-disengaging position;

a shell retention strap releasably engaging the plurality of shell retention members and maintaining the plurality of shell retention members in the shell-engaging position, the shell retention strap and the plurality of shell retention members retaining the pair of interfaceable hemispherical shell sections in the closed shell configuration of the containment shell;

a retainer piston disposed in the trigger housing, the retainer piston selectively positional in a strap-retaining configuration engaging the shell retention strap and a strap-releasing configuration disengaging the shell retention strap; and the retainer piston configured to engage the shell retention strap and maintain the pair of interfaceable hemispherical shell sections of the containment shell in the closed shell configuration and disengage the shell retention strap for release of the shell retention strap from the plurality of shell retention members, deployment of the plurality of shell retention members from the shell-engaging position to the shell-disengaging position, disengagement of the plurality of shell retention members from the pair of interfaceable hemispherical shell sections and disengagement of the pair of interfaceable hemispherical shell sections from each other in deployment of the containment shell to the open shell configuration.

8. The firefighting gas releasing apparatus of claim 7 wherein the plurality of shell retention members comprises a primary shell retention member carried by the trigger housing and a plurality of secondary shell retention members disposed in spaced-apart relationship to the primary shell retention member and to each other.

9. The firefighting gas releasing apparatus of claim 7 wherein the plurality of shell retention members comprises a shell retention member wall; a shell retention cavity configured to receive the pair of interfaceable hemispherical shell sections of the containment shell; and a strap recess configured to receive the shell retention strap.

10. The firefighting gas releasing apparatus of claim 7 further comprising a piston spring engaging and biasing the retainer piston in the strap-retaining configuration.

11. The firefighting gas releasing apparatus of claim 10 further comprising a piston release lever pivotally carried by the trigger housing and pivotally engaging the retainer piston, the piston release lever configured to facilitate deployment of the retainer piston from the strap-retaining configuration to the strap-releasing configuration.

12. The firefighting gas releasing apparatus of claim 7 wherein the trigger housing comprises a trigger housing side wall, a trigger housing cap on the trigger housing side wall, a piston housing on the trigger housing cap, a pin opening in the piston housing and a piston retainer pin removably disposed in the pin opening, the piston retainer pin configured to engage and maintain the retainer piston in the strap-retaining configuration.

13. A firefighting gas releasing method, comprising:

obtaining at least one firefighting gas releasing apparatus having a trigger housing, a retainer piston positional in a strap-retaining configuration and a strap-releasing configuration in the trigger housing and an openable containment shell with a pair of interfaceable hemispherical shell sections releasably carried by the trigger housing, a plurality of male shell retention flanges extending in spaced-apart relationship to each other from a first one of the pair of interfaceable hemispherical shell sections and a plurality of female shell retention flanges extending in spaced-apart relationship to each other from a second one of the pair of interfaceable hemispherical shell sections;

deploying the containment shell in a closed shell configuration by inserting the plurality of male shell retention flanges into the plurality of female shell retention flanges, respectively, to form a plurality of paired interlocking shell retention flanges imparting a fluid-tight seal between the pair of interfaceable hemispherical shell sections;

placing a plurality of shell retention members into engagement with the plurality of paired interlocking shell retention flanges;

placing a shell retention strap into engagement with the plurality of shell retention members;

deploying the retainer piston in the strap-retaining configuration to engage the shell retention strap and retain the containment shell in the closed shell configuration;

placing at least one fire-suppressing gas in the containment shell;

deploying the firefighting gas releasing apparatus over at least a portion of at least one fire; and forming at least one gaseous fog enclosure over the at least a portion of the at least one fire by opening the containment shell and releasing the at least one fire-suppressing gas from the containment shell over the at least a portion of the at least one fire by deploying the retainer piston from the strap-retaining configuration to the strap-releasing configuration.

14. The firefighting gas releasing method of claim 13 further comprising securing the retainer piston in the strap-retaining configuration by deploying a piston retainer pin into engagement with the retainer piston.

15. The firefighting gas releasing method of claim 13 wherein deploying the retainer piston from the strap-retaining configuration to the strap-releasing configuration comprises deploying the retainer piston from the strap-retaining configuration to the strap-releasing configuration by actuation of a piston release lever pivotally carried by the trigger housing and pivotally engaging the retainer piston.

16. The firefighting gas releasing method of claim 13 wherein deploying the firefighting gas releasing apparatus over at least a portion of at least one fire comprises deploying the firefighting gas releasing apparatus over at least a portion of at least one fire from an aircraft.

* * * * *